United States Patent [19]

Ohgaki et al.

[11] Patent Number: 4,551,071

[45] Date of Patent: Nov. 5, 1985

[54] DIAPHRAGM-TYPE FUEL PUMP

[75] Inventors: Kichio Ohgaki; Kazuhiro Ohshima, both of Ibaragi, Japan

[73] Assignee: Kyosan Denki Kabushiki Kaisha, Tokyo, Japan

[21] Appl. No.: 616,459

[22] Filed: Jun. 1, 1984

[30] Foreign Application Priority Data

| | | |
|---|---|---|
| Jun. 2, 1983 [JP] | Japan | 58-96975 |
| Jun. 2, 1983 [JP] | Japan | 58-96977 |
| Jun. 2, 1983 [JP] | Japan | 58-96979 |
| Jun. 2, 1983 [JP] | Japan | 58-96980 |

[51] Int. Cl.[4] ..... F04B 39/16; F04B 39/14; F04B 43/14

[52] U.S. Cl. ..... 417/313; 210/DIG. 5; 417/471; 417/566; 92/78

[58] Field of Search ..... 417/471, 566, 313; 92/78; 210/DIG. 5, 416.5

[56] References Cited

U.S. PATENT DOCUMENTS

| | | | |
|---|---|---|---|
| 1,992,549 | 1/1934 | Hampton | 417/471 |
| 2,104,446 | 1/1938 | Babitch et al. | 417/471 |
| 2,285,163 | 6/1942 | Knott et al. | 417/471 |
| 2,625,114 | 1/1953 | Coffey | 417/471 |
| 2,840,002 | 6/1958 | Elder et al. | 210/416.4 |
| 2,873,686 | 2/1959 | Harry | 417/471 |
| 3,278,032 | 10/1966 | Smith | 210/416.4 |
| 4,364,825 | 12/1982 | Connor, Jr. | 210/416.4 |
| 4,437,986 | 3/1984 | Hutchins | 210/DIG. 5 |

FOREIGN PATENT DOCUMENTS

| | | | |
|---|---|---|---|
| 2159306 | 9/1978 | Fed. Rep. of Germany | 417/471 |
| 2901981 | 8/1979 | Fed. Rep. of Germany | 417/471 |
| 402246 | 2/1943 | Italy | 417/471 |
| 387586 | 2/1933 | United Kingdom | 417/471 |

*Primary Examiner*—William L. Freeh

*Attorney, Agent, or Firm*—Flynn, Thiel, Boutell & Tanis

[57] ABSTRACT

A fuel filter unit having a fuel inlet chamber is threadedly mounted on a fuel pump for easy detachment therefrom. A tubular holder is fixed to the fuel pump for receiving fuel flowing out of the fuel filter unit when the latter is replaced. The fuel filter unit has a drain groove for collecting foreign matter trapped in fuel, so that any collected foreign matter will be discarded along with the fuel filter unit at the time of replacing the same. The fuel pump and the fuel filter unit are in fluid communication through an arrangement which includes a connector disposed in the fuel pump, and a fuel inlet pipe is connected to the connector through a side wall of the fuel pump. Therefore, it is not necessary to detach the fuel inlet pipe when the fuel filter unit is replaced.

8 Claims, 2 Drawing Figures

DIAPHRAGM-TYPE FUEL PUMP

BACKGROUND OF THE INVENTION

1. Field of the Invention:

The presnt invention relates to a diaphragm-type fuel pump with a built-in fuel filter.

2. Description of the Prior Art:

Diaphragm-type fuel pumps are used in internal combustion engines for automobiles. There are strong demands for smaller-size and lighter diaphragm-type fuel pumps to meet improved fuel economy and energy-saving requirements on automobiles.

To meet the above demands, efforts have been made to reduce the weight of various parts of the fuel pump by using drawn metal-sheet products instead of die casting. It has also been proposed to use parts partly constructed of synthetic resin.

Fuel supply systems for internal combustion engines include a fuel filter for removing dust or other foreign matter from fuel to be fed to the carburetor. The recent trend in the industry is that the fuel filter is incorporated in the fuel pump to meet the demand for the lighter assembly.

However, conventional fuel filters assembled in fuel pumps have the following drawbacks:

It is most important for such fuel filters to allow the fuel pump to be assembled with ease. The prior fuel filter, however, has not been designed to meet such a requirement. The conventional fuel filter construction does not permit easy filter replacement which should be made at frequent intervals. Furthermore, the diameter of the overall fuel pump should be reduced to reduce the size and weight of the fuel pump. The fuel pump is required to be constructed so that the volumes of inlet and outlet chambers may freely be selected for allowing the pump to be designed more easily, and is also required to have good performance.

SUMMARY OF THE INVENTION

It is an object of the present invention to provide a diaphragm-type fuel pump incorporating therein a fuel filter that can be attached and detached with ease.

Another object of the present invention is to provide a diaphragm-type fuel pump having a fuel filter unit that can be thrown away after use.

Still another object of the present invention is to provide a diaphram-type fuel pump having a fuel filter which can be replaced with another fuel filter without having to detach a fuel tube.

A still further object of the present invention is to provide a diaphragm-type fuel pump having a fuel filter for collecting foreign matter from fuel, which can be discarded when the fuel filter is replaced.

A still further object of the present invention is to provide a diaphragm-type fuel pump with a built-in fuel filter, which fuel pump is of a small size with a reduced diameter, height and weight.

A yet further object of the present invention is to provide a diaphragm-type fuel pump having a fuel filter unit detachably incorporated therein and constructed to prevent fuel from flowing out and starting a fire when replacing the fuel filter unit.

According to the present invention, a diaphragm-type fuel pump has a fuel filter unit doubling as a fuel inlet chamber and threadedly supported on the upper surface of an outer chamber housing of the fuel pump. A fuel inlet pipe is attached to the outer chamber housing so that the fuel filter unit can easily be attached and detached.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
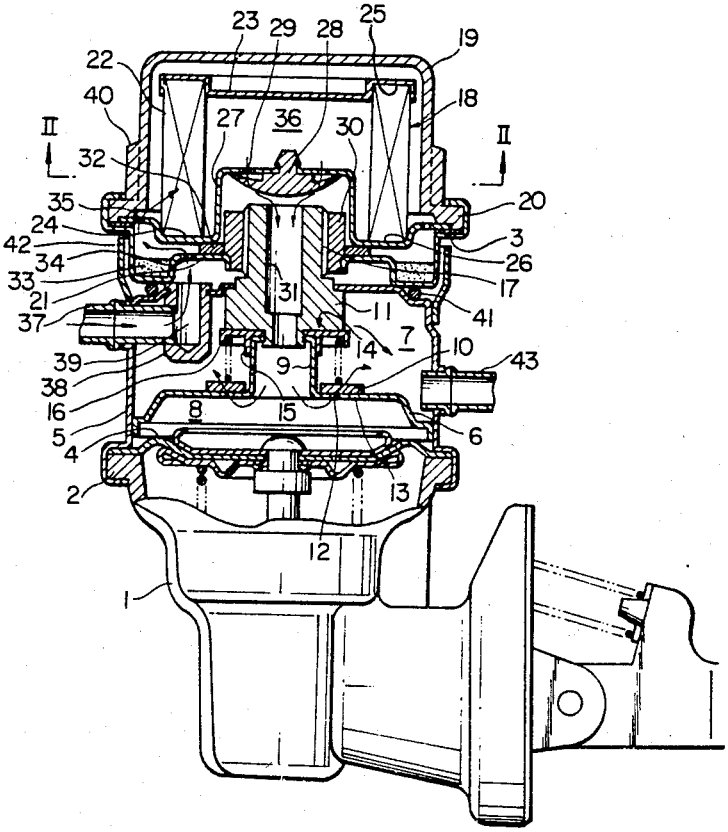
FIG. 1 is a cross-sectional view of a diaphragm-type fuel pump according to the present invention.

As shown in FIG. 1, a diaphragm-type fuel pump includes a lower body 1 comprising a die casting or made of synthetic resin and having a flange 2 on which there is mounted a peripheral edge of a diaphragm 4 staked in position by a skirt end of an outer chamber housing 5.

A separator 6 is press-fitted in the outer chamber housing 5 and divides a space enclosed by the outer chamber housing 5 and the diaphragm 4 into an upper space serving as a fuel outlet chamber 7 and a lower space serving as a fuel pump chamber 8.

The separator 6 has a central upstanding tube 9 doubling as a guide for a ring-shaped outlet valve 10 and as a support for a bolt joint 11, described later on.

The outlet valve 10 serves to open and close a plurality of outlet ports 12 defined in the separator 6 in a circular pattern. The outlet valve 10 is normally urged by a spring 13 in a direction to close the outlet holes 12.

The bolt joint 11 is staked on an upper end of the tube 9 with a spring holder 14 sandwiched therebetween, thus requiring no seal between the tube 9 and the bolt joint 11.

The spring holder 14 has two concentric annular ridges 15, 16 disposed radially inwardly and outwardly. The upper end of the tube 9 is fitted in the inner annular ridge 15. The portion of the spring holder 14 between the inner and outer ridges 15, 16 serves as a spring seat against which the upper end of the spring 13 is held.

The bolt joint 11 includes an upper portion projecting upwardly through an upper surface or upper wall of the outer chamber housing 5, the upper portion having external screw threads 17 above the upper surface of the outer chamber housing 5.

A fuel filter unit 18 includes an upper casing 19 having a flange 20, a lower casing 21 staked on the flange 20 with a gasket 3 sandwiched therebetween, and a pleated paper filter 22 sealingly bonded or otherwise fixed to upper and lower seats 23, 24 in annular grooves 25, 26 therein. The peripheral edge of the lower seat 24 is sandwiched between the flange 20 and the lower casing 21.

The lower seat 24 has a central upstanding boss 27 projecting into the paper filter 22. A fuel inlet valve 28 comprising an umbrella valve in the illustrated embodiment is mounted on an upper surface of the boss 27 for opening and closing fuel inlet ports 29 defined in the upper surface of the boss 27 in a circular pattern.

A nut joint 30 is mounted on the lower casing 21 and partly disposed in the boss 27. The bolt joint 11 is threaded in the nut joint 30. The nut joint 30 has a lower portion extending downwardly from the boss 27.

The bolt joint 11 has a central through hole 31 providing communication between the fuel inlet ports 29 with the pump chamber 8.

There is a seal ring 32 disposed around the nut joint 30 and between the lower casing 21 and the lower seat 24.

The lower casing 21 has an annular drain groove 33 adjacent to an outer peripheral edge thereof, and a plurality of ports 34 defined in a circular pattern and positioned radially inwardly of the drain groove 33 and disposed upwardly of the drain groove 33.

The lower seat 26 has a plurality of ports 35 defined in a circular pattern and positioned radially outwardly of the paper filter 22 and upwardly of the drain groove 33.

The fuel filter unit 18 has an interior space serving as a fuel inlet chamber 36.

A fuel inlet pipe 37 extends through a side wall of the outer chamber housing 5 and has an end fitted in a connector 38 staked on the upper surface of the outer chamber housing 5. The connector 38 has a through hole 39 opening upwardly, the end of the fuel inlet pipe 37 opening into the through hole 39. The connector 38 is made of metal or synthetic resin and serves to guide fuel introduced from the fuel inlet pipe 37 onto the upper surface of the outer chamber housing 5.

Figure 2:
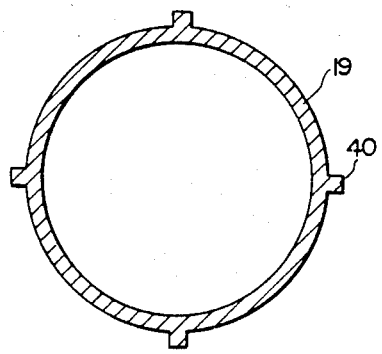
FIG. 2 is a cross-sectional view taken along line II—II of FIG. 1, showing an upper casing of a fuel filter.

As shown in FIG. 2, the upper casing 19 of the fuel filter unit 18 has a plurality of ribs on its outer peripheral surface at circumferentially spaced intervals. The ribs 40 will be held against a jig (not shown) at the time the fuel filter unit 18 is threadedly mounted. It is preferable that the upper casing 19 be of an increased wall thickness where the ribs 40 are formed thereon.

A seal ring 41 is disposed between the lower casing 21 below the drain groove 33 and the upper surface of the outer chamber housing 5. A substantially tubular gasoline holder 42 is fixed to an upper portion of the outer chamber housing 5. The upper surface of the outer chamber housing 5 and the gasoline holder 42 jointly constitute a substantially cup-shaped gasoline reservoir.

A fuel outlet pipe 43 is attached to a side wall of the outer chamber housing 5.

Operation of the fuel pump thus constructed is as follows:

When the diaphragm 4 is reciprocally moved vertically, fuel flows through the fuel pump in the following manner: Fuel introduced from the fuel inlet pipe 37 flows through the hole 39 in the connector 38, the ports 34, and the ports 35 to the paper filter 22. While the fuel is flowing, foreign matter or water trapped in the fuel is collected in the drain groove 33. Since the collected substance is removed together with the fuel filter unit 18 at the time of replacing the fuel filter unit 18, it is not necessary to clean the fuel filter unit 18 each time it is contaminated to capacity.

The fuel, after passing through the paper filter 22, flows through the fuel inlet ports 29 and forces open the fuel inlet valve 28, and then goes through the hole 31 to the pump chamber 8.

The fuel in the pump chamber 8 is caused by the reciprocally moving diaphragm 4 to flow through the fuel outlet ports 12, while lifting the fuel outlet valve 10, and then to flow from the fuel outlet chamber 7 through the fuel outlet pipe 43 toward a carburetor (not shown).

The fuel filter unit 18 will be replaced as follows:

A jig (not shown) is held against the ribs 40 on the upper casing 19 and rotated to cause the nut joint 30 to disengage from the bolt joint 11 to thereby detach the fuel filter unit 18. If a small amount of fuel remains trapped in the fuel filter unit 18, then it tends to flow down through the ports 35, 34. However, such dropping fuel is received in the cup-shaped gasoline reservoir defined by the gasoline holder 42 and the upper surface of the outer chamber housing 5. Therefore, the fuel is prevented from falling into an engine room and bringing about a fire.

Since the collected dust or other foreign matter in the drain groove 33 is removed along with the fuel filter unit 18, no such collected foreign matter will remain in the fuel pump for an extended period of time. It is not necessary to clean and wash the fuel pump after the fuel filter unit 18 has been removed.

A new fuel filter unit 18 can be installed in place by being rotated by the jig to cause the nut joint 30 to be threaded over the bolt joint 11. The filter replacement is now completed.

In the above embodiment, the lower body 1 is in the form of a die casting or a synthetic resin body, as described above. Although the upper casing 19 of the fuel filter unit 18 should preferably be made of synthetic resin, it may be constructed of a metal sheet or a die casting. The bolt and nut joints 11, 30 are made of metal, and the outer chamber housing 5 and the separator 6 are in the form of metal sheets. The connector 38 should preferably be made of metal, but may be made of synthetic resin.

The present invention, however, is not limited to the materials referred to above, but may cover other materials in its scope.

The diaphragm-type fuel pump according to the present invention has the following advantages:

The fuel filter unit can be attached and detached quite easily.

The fuel filter unit can be thrown away after use, and hence replaced with utmost ease.

Since the fuel inlet pipe is mounted on the outer chamber housing, the fuel inlet pipe is not required to be detached at the time of replacing the fuel filter unit. Unwanted troubles such as fuel leakage are reduced, since the fuel inlet pipe as mounted on the outer chamber housing is subjected to no undue forces. The fuel pump is therefore highly reliable and safe.

With the drain groove for collecting foreign matter being in the fuel filter unit, any collected foreign matter can be removed when the fuel filter unit is replaced.

Since the fuel inlet valve is disposed in the fuel filter unit, the height of the fuel pump is reduced and hence the fuel pump is smaller in size and lighter in weight.

Introduced fuel flows centrally through the fuel filter unit and the fuel pump, so that the diaphragm-type fuel pump can be reduced in overall diameter.

As the volume of the fuel filter unit is equal to the volume of the fuel inlet chamber, the fuel filter unit is of a design having no wasteful space, and is small in size and light in weight.

There is no danger of a fire at the time of replacing the fuel filter due to gasoline which drops out of the fuel filter unit.

Although a certain preferred embodiment has been shown and described, it should be understood that many changes and modifications may be made therein without departing from the scope of the appended claims.

What is claimed is:

1. A diaphragm-type fuel pump, comprising:

an outer chamber housing made of a metal plate and having therein a fuel outlet chamber, a pump chamber, and pump means for pumping fuel from said pump chamber into said fuel outlet chamber, said pump means including a reciprocally movably diaphragm, said outer chamber housing having an upper wall and a side wall;

a fuel filter unit supported on an upper surface of said upper wall and said outer chamber housing and means for detachably securing said fuel filter unit to said outer chamber housing, said fuel filter unit having a fuel inlet chamber therein, a filter disposed in said fuel inlet chamber, and substantially centrally located fuel inlet valve means for allowing fuel to pass through said filter, said inlet valve means including a valve member made of rubber;

a connector disposed in said outer chamber housing, having an end attached to said upper wall thereof, and having a hole therein which communicates with an opening provided through said upper wall of said outer chamber housing;

a fuel inlet pipe extending from said connector through said side wall of said outer chamber housing and having a passageway therein which communicates with said hole in said connector; wherein said fuel filter unit includes a lower casing having an annular drain groove along an outer peripheral edge thereof and having a plurality of ports therethrough, fuel from said inlet pipe flowing through said connector, through said opening in said upper wall, through said ports in said lower casing, into said fuel inlet chamber, and through said filter in said fuel inlet chamber, said ports in said lower casing being located vertically higher than said annular drain groove; and wherein said means for detachably securing said filter unit to said outer chamber housing includes a nut fixedly and substantially centrally supported on said fuel filter unit and a bolt supported on said outer chamber housing and extending substantially centrally through said upper wall thereof, said nut being threaded over said bolt, said bolt extending into said fuel filter unit, and said bolt having a hole therethrough which provides fluid communication between said fuel inlet chamber and said pump chamber; and a substantially tubular fuel holder fixed to said outer chamber housing and projecting upwardly past said upper wall thereof, said upper wall of said outer chamber housing and said fuel holder together defining a substantially cup-shaped fuel reservoir below said fuel filter unit, said cup-shaped fuel reservoir receiving fuel which drops from said fuel filter unit when said fuel filter unit is detachable from said outer chamber housing.

2. A diaphragm-type fuel pump, comprising:

a housing having a fuel inlet, a fuel outlet, an upwardly facing exterior surface portion and a tubular fuel holder which extends upwardly from peripheral edges of said upwardly facing surface portion, said tubular fuel holder and said upwardly facing surface portion defining an upwardly open fuel reservoir; a fuel filter unit which includes a substantially closed casing and a fuel filter provided in said casing, said casing having a lower end which is disposed within said fuel reservoir; means for detachably securing said fuel filter unit to said housing, including a threaded opening provided in one of said lower end of said casing and said upwardly facing surface portion of said housing and a bolt fixedly secured on the other of said casing and said housing, said bolt being threadedly engaged in said threaded opening and having a central longitudinal hole therethrough; an annular seal which is spaced from and extends around said bolt and which sealingly engages said lower end of said casing and said upwardly facing surface on said housing; means defining an outlet hole in said upwardly facing surface portion of said housing at a location between said bolt and said annular seal; means defining an upwardly facing impurities collecting recess within said casing of said fuel filter; means defining an inlet port which extends into said lower end of said casing from a location between said bolt and said annular seal and which opens into the interior of said casing at a location in the region of and vertically higher than said collecting recess; pump means in said housing for causing fuel to flow from said fuel inlet to said outlet opening, into said casing through said inlet opening, through said casing and into said hole through said bolt, and from said hole through said bolt through said fuel outlet, said pump means including a reciprocally movable diaphragm; and means in said fuel filter unit for causing fuel to pass through said filter therein as it flows from said inlet opening to said hole in said bolt.

3. The fuel pump according to claim 2, wherein said housing includes an upper wall which is made from a metal plate and has said upwardly facing surface on an upper side thereof, wherein said housing includes a connector which is secured in an opening in said metal plate and has a hole therein which is said outlet hole, and including an inlet pipe which communicates with said hole in said connector and extends from said connector through a side wall of said housing, said inlet pipe being said fuel inlet.

4. The fuel pump according to claim 2, wherein said lower end of said casing is made from a bent sheet metal plate, said collecting recess being an annular groove which is provided in said bent sheet metal plate so as to be concentric with respect to said bolt, said sheet metal plate having a plurality of said inlet ports therethrough at respective locations which are angularly spaced and located radially inwardly of said annular collecting groove.

5. The fuel pump according to claim 4, wherein said means for causing fuel to pass through said filter includes a lower filter seat which is a platelike member extending across and dividing the interior of said casing into two portions, wherein said casing has means defining an upper filter seat thereon at a location above said lower filter seat, wherein said filter is annular and has its axial ends respectively sealingly disposed against said lower and upper filter seats, wherein said lower filter seat has a plurality of angularly spaced ports therethrough which are located radially outwardly of said filter, and including means providing fluid communication between said hole through said bolt and the region within said annular filter.

6. The fuel pump according to claim 5, wherein said lower filter seat has an upwardly projecting boss in the center thereof which extends axially into the central opening in said filter, wherein said bolt is provided on said housing, wherein said filter unit includes a nut which is fixedly secured in an opening in said sheet metal plate of said casing and defines said threaded opening, and wherein said means for providing fluid communication between said hole through said bolt and the region within said filter includes plural ports provided through said boss and an annular seal which encircles said nut and sealingly engages said nut and said lower filter seat.

7. The fuel pump according to claim 6, including inlet valve means supported on said lower filter seat for controlling fuel flow through said ports in said boss thereof, said inlet valve means facilitating fuel flow through said bolt and obstructing fuel flow through said ports in the opposite direction.

8. The fuel pump according to claim 7, wherein said inlet valve means includes a rubber valve member which is supported on an underside of said boss and has a flexible peripheral portion movable between positions engaging said boss and obstructing fluid flow through said ports and a position spaced from said boss and facilitating fluid flow through said ports.

* * * * *

UNITED STATES PATENT AND TRADEMARK OFFICE

CERTIFICATE OF CORRECTION

PATENT NO. : 4 551 071

DATED : November 5, 1985

INVENTOR(S) : Kichio OHGAKI et al

It is certified that error appears in the above-identified patent and that said Letters Patent is hereby corrected as shown below:

Column 5, line 57; change "detachable" to ---detached---.

Column 8, line 2; before "bolt" insert ---ports in a direction from said filter to said hole through said---.

Signed and Sealed this

*Eighth* Day of *April 1986*

[SEAL]

*Attest:*

DONALD J. QUIGG

*Attesting Officer*

*Commissioner of Patents and Trademarks*